US008001786B2

(12) United States Patent
Oda et al.

(10) Patent No.: US 8,001,786 B2
(45) Date of Patent: Aug. 23, 2011

(54) COMBUSTOR OF A GAS TURBINE ENGINE

(75) Inventors: Takeo Oda, Kobe (JP); Atsushi Horikawa, Akashi (JP); Hideki Ogata, Kakogawa (JP)

(73) Assignee: Kawasaki Jukogyo Kabushiki Kaisha, Kobe (JP)

( * ) Notice: Subject to any disclaimer, the term of this patent is extended or adjusted under 35 U.S.C. 154(b) by 414 days.

(21) Appl. No.: 12/068,733

(22) Filed: Feb. 11, 2008

(65) Prior Publication Data

US 2008/0302105 A1 Dec. 11, 2008

(30) Foreign Application Priority Data

Feb. 15, 2007 (JP) ..... 2007-035209

(51) Int. Cl.
*F02C 1/00* (2006.01)

(52) U.S. Cl. ..... 60/749; 60/742

(58) Field of Classification Search ..... 60/737, 60/740, 742, 748–749; 431/8
See application file for complete search history.

(56) References Cited

U.S. PATENT DOCUMENTS

| | | | | |
|---|---|---|---|---|
| 6,389,815 | B1 | 5/2002 | Hura et al. | |
| 6,453,660 | B1 * | 9/2002 | Johnson et al. | 60/39.821 |
| 6,986,255 | B2 * | 1/2006 | Smith et al. | 60/776 |
| 2005/0097889 | A1 * | 5/2005 | Pilatis et al. | 60/743 |
| 2007/0028619 | A1 * | 2/2007 | Spooner | 60/737 |

FOREIGN PATENT DOCUMENTS

| | | | |
|---|---|---|---|
| EP | 1 413 830 | A2 | 4/2004 |
| EP | 1 750 056 | A2 | 2/2007 |
| EP | 1 801 504 | A2 | 6/2007 |
| EP | 1 953 455 | A1 | 8/2008 |
| JP | 59-129330 | | 7/1984 |
| JP | A 5-87340 | | 4/1993 |
| JP | A 2002-115847 | | 4/2002 |
| JP | A 2002-139221 | | 5/2002 |
| JP | A 2002-168449 | | 6/2002 |
| JP | A 2003-4232 | | 1/2003 |
| WO | WO 03/091557 | A1 | 11/2003 |

OTHER PUBLICATIONS

European Search Report for European Application No. 08151391.3—1266/1959196, mailed Jun. 1, 2010.

* cited by examiner

*Primary Examiner* — Louis J. Casaregola
*Assistant Examiner* — Phutthiwat Wongwian
(74) *Attorney, Agent, or Firm* — Oliff & Berridge, PLC

(57) ABSTRACT

A combustor of gas turbine engine, including: a fuel spray portion that sprays fuel to create a diffusion combustion region in a combustion chamber, the fuel spray portion including a fuel atomizing portion that atomizes the fuel, and a diffusion passage portion disposed downstream of the fuel atomizing portion, the diffusion passage portion having a spreading trumpet-like shape and diffuses the fuel and the air; a pre-mixture supply portion that supplies a pre-mixture gas including the fuel and air to create a pre-mixture combustion region in the combustion chamber, the pre-mixture supply portion being positioned concentrically with the fuel spray portion to surround the fuel spray portion; and a fuel diffusion restraining member disposed on an inner circumferential face of the diffusion passage portion for restraining a diffusion of injected fuel by separating a stream of the injected fuel away from the inner circumferential face.

7 Claims, 8 Drawing Sheets

-- PRIOR ART --

COMBUSTOR OF A GAS TURBINE ENGINE

CROSS REFERENCE TO RELATED APPLICATIONS

This application is based upon the prior Japanese Patent Application No. 2007-35209 filed on Feb. 15, 2007, the entire contents of which are incorporated herein by reference.

TECHNICAL FIELD

The present invention relates to a combustor for use in a gas turbine engine including a fuel injection structure of a composite combustion type comprising a combination of two combustion systems, i.e., a diffusion combustion system and a lean pre-mixture combustion system.

BACKGROUND ART

For the gas turbine engine, in view of the environmental protection, strict criteria are applied, with respect to the composition of exhaust gases to be generated by combustion. In the criteria, reduction of harmful matters, such as nitrogen oxides (hereinafter, referred to as NOx), is greatly required. On the other hand, in the case of large-size gas turbines and/or engines for airplanes, from the requirements of reducing the fuel consumption and enhancing the output, the pressure ratio currently tends to be set higher. Associated with such a tendency, higher temperature and/or higher pressure operations are to be employed around the input port of the combustor. Therefore, due to such operations to elevate the temperature around the input port of the combustor, the combustion temperature may also tend to be higher, leading to further increase of NOx.

In recent years, a composite combustion method has been proposed, in which the lean pre-mixture combustion system that can effectively reduce the generation amount of NOx and the diffusion combustion system excellent in both of the ignition performance and the flame holding performance are combined together (see Patent Documents Nos. 1, 2, 3, 4, 5, 6 mentioned hereunder). In the lean pre-mixture combustion system, air and a fuel are mixed in advance so as to combust or burn the so-obtained mixed gas or mixture, with the fuel concentration of the gas being uniform. Thus, there should be no region where the flame temperature is locally elevated. In addition, the flame temperature can be lowered over the whole region due to the dilution of the fuel. Therefore, the amount of generation of NOx can be effectively reduced. However, because a great amount of air is mixed uniformly with the fuel, the local fuel concentration over the combustion region should be significantly low. Thus, the stability of combustion, especially under lower intensity combustion, may tend to be deteriorated. On the other hand, the diffusion combustion system is configured to perform combustion while diffusing and mixing the fuel and air. Therefore, flame failure of the combustion is not likely to occur even under lower intensity combustion, presenting a superior flame holding performance. Accordingly, the composite combustion system can ensure the stability of combustion, while starting the operation and/or operating under lower intensity combustion, due to its diffusion combustion region, while it can reduce the amount of generation of the NOx, under higher intensity combustion, due to its lean pre-mixture combustion region.

A combustor for the composite combustion system, as shown in FIG. 8, includes a fuel spray portion 81 adapted to spray a fuel so as to form the diffusion combustion region, due to the diffusion combustion system, in a combustion chamber 80, and a pre-mixture supply portion 82 shaped concentrically relative to the fuel spray portion 81 to surround the outer circumference of the fuel spray portion 81, and adapted for supplying a pre-mixture of a fuel and air so as to form the pre-mixture combustion region, due to the lean pre-mixture combustion system, in the combustion chamber 80. The combustor is configured to supply a fuel only from the fuel spray portion 81 while starting the operation and/or operating under a lower intensity combustion mode, whereas, on a higher intensity combustion mode, it supplies the fuel also from the pre-mixture supply portion 82, in addition to supplying of the fuel from the fuel spray portion 81. The fuel spray portion 81 includes a fuel atomizing portion 81*a*, which is adapted to change the fuel into particles suitable for combustion by utilizing shearing force of air, and a diffusion passage portion 81*b* disposed on the downstream side of the fuel atomizing portion 81*a*, adapted to diffuse the fuel and air at a speed suitable for the combustion, and having a spreading trumpet-like shape. In this case, it is intended to enhance the combustion efficiency, due to the diffusion combustion to be achieved by spreading the diffusion combustion region. Specifically, the spreading of the diffusion combustion region can be achieved by employing the diffusion passage portion 81*b* and a guide skirt member 81*c* further spreading out from the diffusion passage portion 81*b* up to the inner periphery of a downstream end of the pre-mixture supply portion 82.

Patent Document 1: JP No. 5-87340 A
Patent Document 2: JP No. 2002-115847 A
Patent Document 3: JP No. 2002-139221 A
Patent Document 4: JP No. 2002-168449 A
Patent Document 5: JP No. 2003-4232 A
Patent Document 6: U.S. Pat. No. 6,389,815

In such a configuration described above, while the fuel 84 is supplied only from the fuel spray portion 81 while starting the operation and/or operating under lower intensity combustion, only a great amount of air 85 is supplied into the combustion chamber 80 from the pre-mixture supply portion 82. As schematically shown in FIG. 8, the fuel 84 is injected in a direction toward the inner periphery of the downstream end of the pre-mixture supply portion 82 by air, along the diffusion passage portion 81*b* and guide skirt member 81*c* in a spreading trumpet-like shape. Thus, diffusion combustion flame 83 to be created by the mixture including the fuel 84 is also guided to spread into the entire space of the combustion chamber 80. However, the air 85 supplied from the pre-mixture supply portion 82 will interfere with the outer circumferential region of the so-created diffusion combustion flame 83. The interferential range between the diffusion combustion flame 83 and the air 85 is schematically depicted in FIG. 8, by using lattice-like hatching. The influence of such interference makes the local fuel concentration significantly lower at the outer circumferential portion of the diffusion combustion region as well as makes it difficult to keep the fuel concentration range to be suitable for stable combustion. Thus, flame failure in the diffusion combustion flame 83 may tend to occur, leading to deterioration of the ignition performance, the flame holding performance, and the stability of combustion under lower intensity combustion.

In particular, in the case of gas turbine engines used for airplanes, secure ignition is required under the conditions of lower temperature and lower pressure at a higher altitude, and various restrictions are imposed, with regard to harmful exhaust matters, such as CO and/or THC (Total HC), under lower intensity combustion, including idling time. Therefore, the degradation of the ignition performance and stability of combustion, due to the great amount of air 85 supplied from the pre-mixture supply portion 82 may often be problematic.

SUMMARY OF INVENTION

The present invention was made in light of the above challenges posed on the conventional art, and it is therefore an object thereof to provide a combustor for use in the gas turbine engine, the combustor having a structure of a composite combustion system comprising a combination of the two combustion systems, i.e., the diffusion combustion system and the lean pre-mixture combustion system, and being able to securely enhance the ignition performance, the flame holding performance, and the stability of combustion under lower intensity combustion.

In order to achieve the above object, the combustor of a gas turbine engine according to the present invention, includes: a fuel spray portion configured to spray a fuel so as to create a diffusion combustion region in a combustion chamber, the fuel spray portion including a fuel atomizing portion configured to atomize the fuel, and a diffusion passage portion disposed downstream of the fuel atomizing portion, the diffusion passage portion having a spreading trumpet-like shape and being configured to diffuse the fuel and the air; a pre-mixture supply portion configured to supply a pre-mixture gas including the fuel and an air so as to create a pre-mixture combustion region in the combustion chamber, the pre-mixture supply portion being positioned concentrically with the fuel spray portion so as to surround the fuel spray portion; and fuel diffusion restraining means disposed on an inner circumferential face of the diffusion passage portion for restraining a diffusion of an injected fuel by separating a stream of the injected fuel away from the inner circumferential face.

In this combustor, only the air may be supplied from the pre-mixture supply portion into the diffusion combustion region while starting an operation of the engine and/or operating the engine under low intensity combustion.

In the present invention having the configuration described above, the fuel injected from the fuel atomizing portion of the fuel spray portion is separated away from the inner circumferential face of the diffusion passage portion due to the fuel diffusion restraining means disposed on the diffusion passage portion located downstream of the fuel atomizing portion, and is then controlled to be flown along and around the axis of the fuel spray portion with the diffusion of the fuel being suppressed. Thus, undue spreading in the radial and outward directions of the diffusion combustion region to be created by the fuel can be avoided, thereby providing an appropriately fuel-rich region effective for the diffusion combustion around the axis of the fuel spray portion. In addition, the fuel diffusion restraining means serves to prevent the fuel, which is injected from the fuel atomizing portion, from changing into a liquid film form, traveling along the inner circumferential face of the diffusion passage portion, and then flowing into a great amount of air to be supplied from the pre-mixture supply portion.

Accordingly, unnecessary mixing of the great amount of air supplied from the pre-mixture supply portion with flame produced in the diffusion combustion region due to the fuel injected into the combustion chamber from the fuel spray portion, while starting the operation and/or operating under low intensity combustion, can be prevented. Thus, flame failure of the flame created in the diffusion combustion chamber, due to a negative effect of the great amount of air, can be prevented. In addition, the entire diffusion combustion region can be always kept in a fuel concentration range suitable for stabilized combustion. Therefore, the ignition performance, the flame holding performance, and the stability of combustion under lower intensity combustion, can be enhanced.

In this invention, it is preferred that the fuel diffusion restraining means is located at an upstream end of the diffusion passage portion. Consequently, the stream of the fuel can be separated from the inner circumferential face of the diffusion passage portion, due to the fuel diffusion restraining means, immediately after the fuel is injected from the fuel atomizing portion of the fuel spray portion, as such effectively restraining the diffusion of the fuel.

In this invention, it is preferred that the fuel diffusion restraining means includes an annular step member having a triangular longitudinal section, the annular step member being disposed on the inner circumferential face so as to protrude from the inner circumferential face. With such a step member having a triangular longitudinal section, in which one inner face is designed to be in parallel with the axial direction of the fuel spray portion, the fuel injected from the fuel atomizing portion can be separated from the inner circumferential face of the diffusion passage portion, at a downstream end of the one inner face of the step member having such a simple shape, while the stream of the fuel being directed in parallel to the axial direction of the fuel spray portion. Therefore, a region of a higher fuel concentration can be created in a downstream region along and around the axis of the fuel spray portion, thereby to provide the diffusion combustion region that can present a significantly higher combustion efficiency.

In this invention, it is preferred that the step member has a length L1 as measured along an axial direction of the diffusion passage portion, and the diffusion passage portion has a length L2 as measured along the axial direction, the length L1 being set between one third of L2 and one half of L2. If the length L1 of the step member along the axial direction of the diffusion passage portion is less than (⅓) L2, the step member would be too short to provide a sufficient effect, due to the step member, for restraining the diffusion of the fuel. Contrary, if the length L1 is greater than (½) L2, the diffusion of air would be suppressed, thus unduly increasing the flowing speed of the mixture of the fuel and air relative to the speed suitable for the combustion, as such making the mixture not likely to be combusted, resulting in unstable combustion.

In this invention, it is preferred that a passage for a cooling air to cool the step member is formed in the step member. Consequently, the step member having been subjected to the radiant heat from the flame in the diffusion combustion region can be cooled effectively, thus eliminating the need for forming the step member from an expensive material particularly superior in the heat resistance. As the cooling air, compressed air to be flown into the combustor from a compressor can be utilized.

In this invention, it is preferred that the passage for the cooling air has an exhaust port for discharging the cooling air from a downstream face of the step member into the diffusion passage portion. Consequently, the cooling air discharged from the exhaust port, after cooling the downstream face of the step member, can enhance the atomization for the fuel to be separated away from the inner circumferential face of the diffusion passage portion due to the effect of the step member.

As mentioned above, according to the combustor for use in the gas turbine engine, the diffusion restraining means disposed on the inner circumferential face of the diffusion passage portion of the fuel spray portion can separate the fuel injected from the fuel atomizing portion, away from the inner circumferential face of the diffusion passage portion, while restraining the diffusion of the fuel, such that the fuel can be flown concentrating around the axis of the fuel spray portion.

Thus, unnecessary mixing of the great amount of air supplied from the pre-mixture supply portion with flame produced in the diffusion combustion region due to the fuel supplied from the fuel spray portion, while starting the operation and/or operating under low intensity combustion, can be prevented. In addition, the entire diffusion combustion region can be kept in a fuel concentration range suitable for stabilized combustion, thus presenting an excellent ignition performance, flame holding performance, and stability of combustion under lower intensity combustion.

BRIEF DESCRIPTION OF DRAWINGS

The above and other objects, features and advantages of the present invention will become more apparent from the following description taken in connection with the accompanying drawings, in which.

DESCRIPTION OF EMBODIMENTS

Hereinafter, preferred embodiments of the present invention will be described with reference to the drawings.

Figure 1:
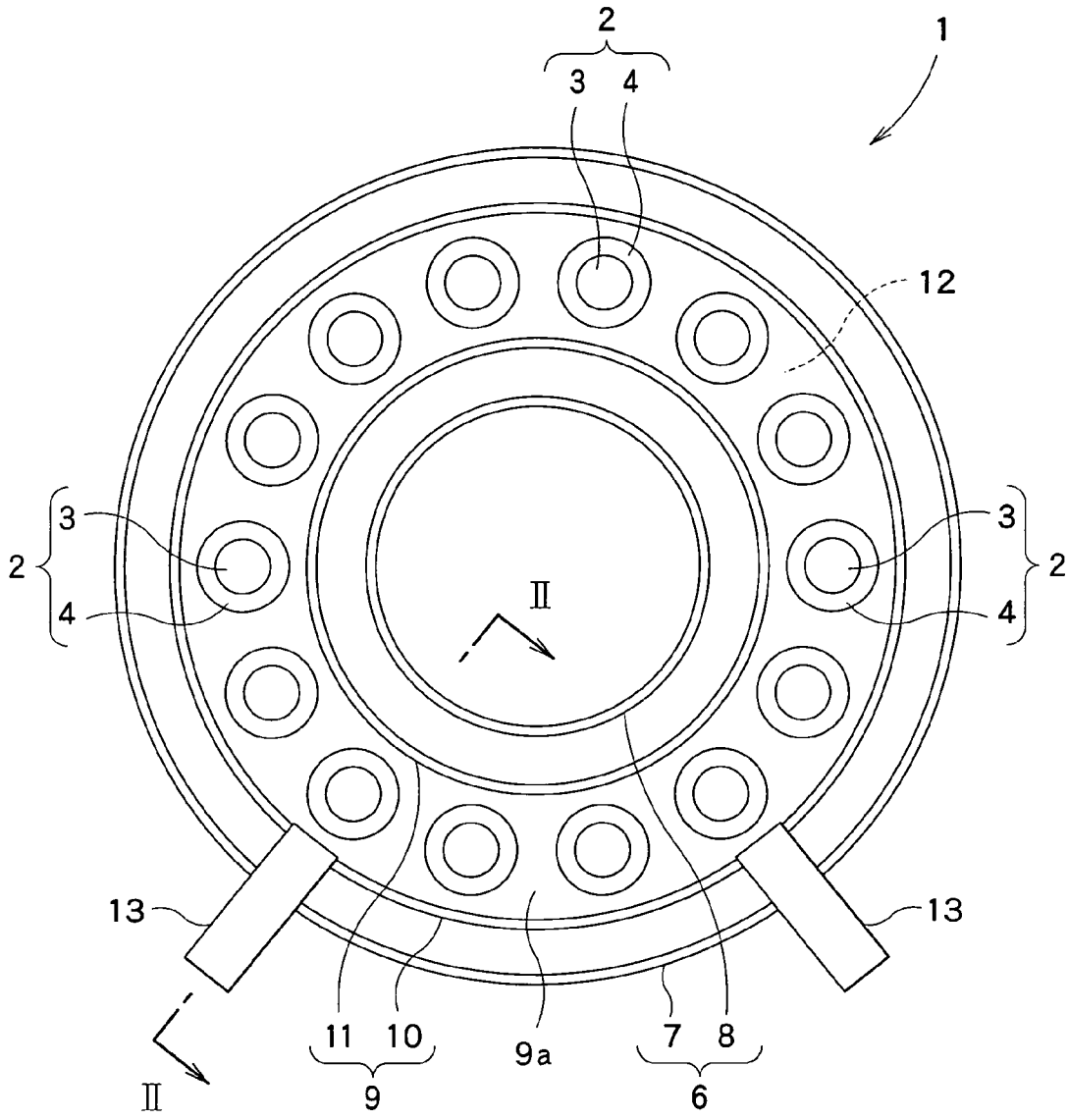
FIG. 1 is a schematic front view showing a combustor for a gas turbine engine according to a first embodiment of the present invention.

FIG. 1 shows a head of a combustor 1 for a gas turbine engine according to a first embodiment of the present invention. The combustor 1 is configured to drive a turbine, by combusting a mixed gas or mixture to be formed by mixing a fuel with compressed air supplied from a compressor (not shown) of the gas turbine engine, and then supplying the so-formed high-temperature and high-pressure combustion gas generated by the combustion to the turbine.

The combustor 1 is of an annular type, in which a combustor housing 6 having an annular internal space is constructed by arranging an annular inner casing 8 concentrically into an annular outer casing 7. In the annular internal space of the combustor housing 6, a combustion cylinder 9, which is constructed by arranging an annular inner liner 11 concentrically into an annular outer liner 10, is arranged concentrically with the combustor housing 6. The combustion cylinder 9 has an annular combustion chamber 12 formed therein. In a top wall 9*a* of the combustion cylinder 9, a plurality of (fourteen (14) in this embodiment) fuel injection units 2 each adapted to inject the fuel into the combustion chamber 12 are positioned concentrically with the combustion cylinder 9 at an equal interval, while arranged in a single circle. Each fuel injection unit 2 includes a fuel spray portion (pilot fuel injection nozzle) 3, and a pre-mixture supply portion (main fuel injection nozzle) 4 configured to surround the outer circumference of the fuel spray portion 3 and arranged concentrically with the fuel spray portion 3. The fuel spray portion 3 and pre-mixture supply portion 4 will be detailed later.

Through the outer casing 7 and outer liner 10, two spark plugs 13 adapted for ignition extend in the radial direction relative to the combustion cylinder 9, with the distal ends thereof being opposed to the fuel ignition units 2. Accordingly, in the combustor 1, the combustible mixed gas injected from the two fuel injection units 2 opposed to the two spark plugs 13 is first ignited, and the flame generated due to the combustion then burns the combustible mixed gas injected from adjacent fuel injection units 2, after another. Finally, the flame transfers to and ignites the mixed gas injected from all the fuel injection units 2.

Figure 2:
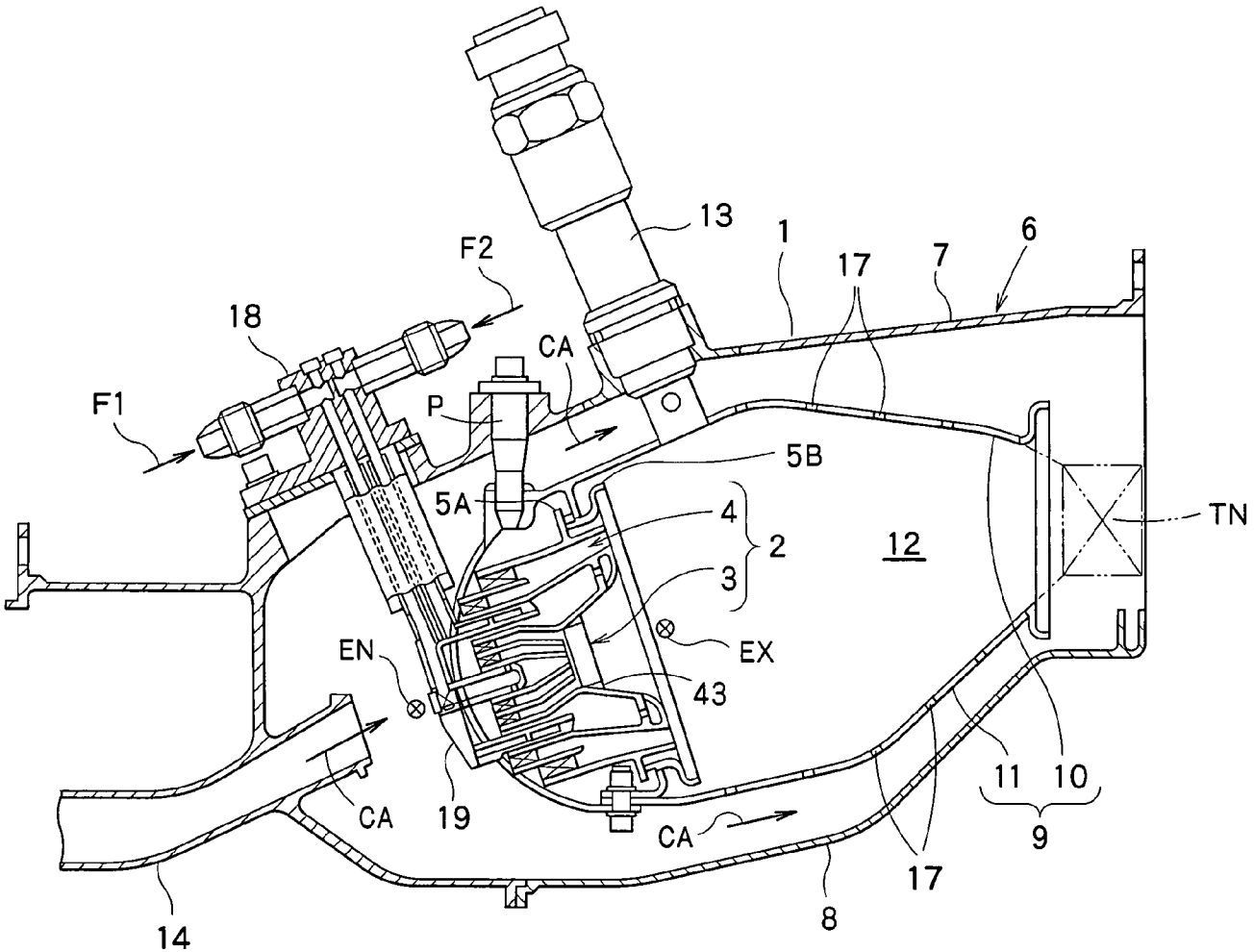
FIG. 2 is an enlarged longitudinal section taken along line II-II of FIG. 1.

FIG. 2 is an enlarged longitudinal section taken along line II-II of FIG. 1. In the annular internal space of the combustor housing 6, compressed air CA supplied from the compressor is introduced via a plurality of air intake pipes 14. The compressed air CA thus introduced is then supplied into the fuel injection unit 2, while being supplied into the combustion chamber 12 through air introduction ports 17 respectively formed in large numbers in the outer liner 10 and inner liner 11 of the combustion cylinder 9. A fuel piping unit 18, constituting a first fuel supply system F1 for supplying a fuel for diffusion combustion into the fuel spray portion 3 and a second fuel supply system F2 for supplying a fuel for lean pre-mixture combustion into the pre-mixture supply portion 4, is supported by the outer casing 7, and is connected with a base 19 of the combustion cylinder 9. Each fuel injection unit 2 is supported by the outer liner 10 via a flange 5A disposed on the outer circumferential portion of the fuel ignition unit 2 and a support member 5B disposed on the outer liner 10. The outer liner 10 is in turn supported by the outer casing 7 via a liner fixing pin P. A first stage nozzle TN of the turbine is connected with a downstream end of the combustion cylinder 9.

Figure 3:
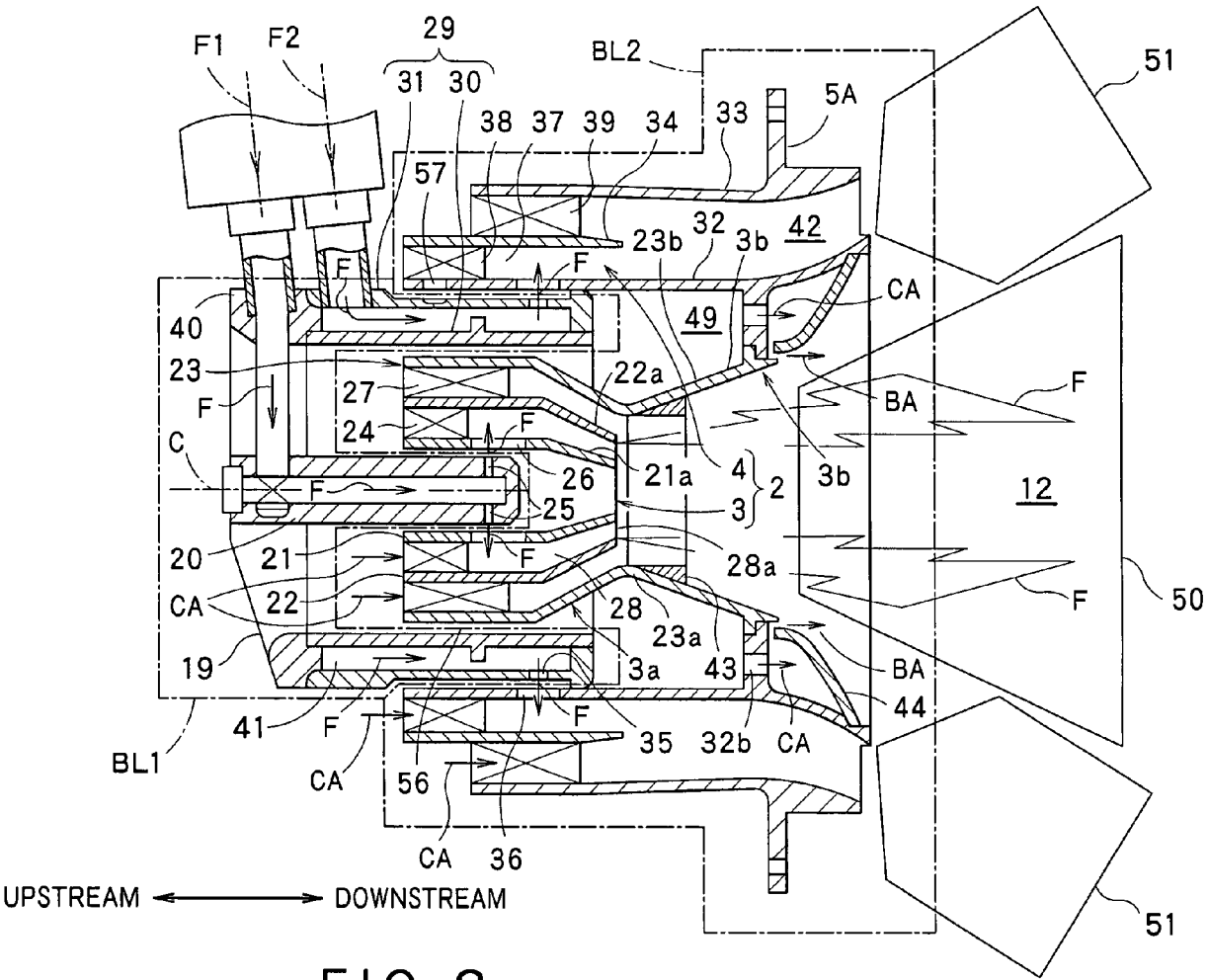
FIG. 3 is a longitudinal section showing a fuel injection unit shown in FIG. 2.

FIG. 3 is a longitudinal section showing the fuel injection unit 2 of FIG. 2 in more detail. The fuel spray portion 3 provided at a central portion of the fuel injection unit 2 includes a cylindrical main body 20 having a bottom portion and adapted to supply the fuel F, for the diffusion combustion, to be fed from the first fuel supply system F1, a cylindrical inner circumferential wall 21 fitted around the main body 20, a cylindrical intermediate wall 22 arranged externally and concentrically relative to the cylindrical inner circumferential wall 21, a nozzle 23 of a Venturi nozzle type, arranged externally and concentrically relative to the cylindrical intermediate wall 22, a first inner swirler 24 positioned between the cylindrical inner circumferential wall 21 and the cylindrical intermediate wall 22, and a first outer swirler 27 positioned between the cylindrical intermediate wall 22 and the nozzle 23.

At a downstream end of the main body 20, a plurality of fuel injection holes 25 are formed radially to inject radially outward the fuel F supplied into the main body 20. In each point of the cylindrical inner circumferential wall 21 corresponding to the fuel injection holes 25, a fuel introduction hole 26 is formed for introducing the fuel F into a primary atomizing passage 28 formed between the cylindrical inner circumferential wall 21 and the cylindrical intermediate wall 22. The fuel F introduced into the primary atomizing passage 28 is then injected from an atomized fuel injection port 28*a* disposed on the downstream side.

The atomized fuel injection port 28*a*, i.e., the downstream end of each of the cylindrical inner circumferential wall 21 and cylindrical intermediate wall 22 is substantially coincident, in position along the axis of the combustor 1, with a throttling portion 23*a*, at which the inner diameter of the nozzle 23 is the minimum. A diameter spreading portion 23*b* extending downstream from the throttling portion 23*a* of the nozzle 23 is formed into a trumpet-like shape having a predetermined spreading angle. Thus, the fuel spray portion 3 includes a fuel atomizing portion 3*a* defined by a portion extending from an upstream end up to the throttling portion 23*a* of the nozzle 23, and a diffusion passage portion 3*b* defined by a portion extending from the throttling portion 23*a* up to a downstream end of the nozzle 23, i.e., the diameter spreading portion 23*b* of the nozzle 23. The fuel atomizing portion 3*a* includes respective downstream ends 21*a*, 22*a* of the cylindrical inner circumferential wall 21 and cylindrical intermediate wall 22 constituting the primary atomizing passage 28, wherein the downstream ends 21*a*, 22*a* are each formed into a tapered truncated conical shape, corresponding to the shape in the opposite position of the nozzle 23. Thus, the fuel atomizing portion 3*a* is configured to inject the fuel F from the primary atomizing passage 28 and the compressed air CA from the first outer swirler 27, respectively, toward the axis C of the main body 20, obliquely, in a layered state. Thereafter, the diffusion passage portion 3*b* disposed downstream of the fuel atomizing portion 3*a* injects the fuel F and the compressed air CA into the combustion chamber 12 at an injection angle defined by the diameter spreading portion 23*b* while diffusing the fuel F together with the compressed air CA.

With the fuel spray portion 3, the fuel F for the diffusion combustion is supplied from the first fuel supply system F1 in all the range of load or intensity, i.e., from the stage while starting the operation and/or operating under lower intensity combustion up to the stage under higher intensity combustion. Specifically, in the fuel atomizing portion 3*a*, the fuel F supplied into the main body 20 is injected from each fuel injection hole 25, and the injected fuel F is then subjected to primary atomization due to the compressed air CA supplied from the first inner swirler 24. Thereafter, the fuel F having been subjected to the primary atomization is further subjected to secondary atomization due to a swirling air stream provided from the first outer swirler 27 in the diffusion passage portion 3*b*, thus being sprayed into the combustion chamber 12, as such creating a diffusion combustion region 50 in the combustion chamber 12.

Next, the pre-mixture supply portion 4 in a form of surrounding the outer circumference of the fuel spray portion 3 will be described. The pre-mixture supply portion 4 includes a cylindrical double-wall main body 29 including an inner cylindrical body 30 and an outer cylindrical body 31, a cylindrical intermediate wall 32 arranged externally and concentrically relative to the main body 29, a cylindrical outer circumferential wall 33 arranged externally and concentrically relative to the cylindrical intermediate wall 32, a cylindrical partition wall 34 for separating the cylindrical intermediate wall 32 from the cylindrical outer circumferential wall 33, a second inner swirler 38 located at an input port of a pre-mixture preparing chamber 37 positioned between the cylindrical intermediate wall 32 and the cylindrical partition wall 34, and a second outer swirler 39 positioned between the cylindrical partition wall 34 and the cylindrical outer circumferential wall 33. The main body 29 is supported by the base 19, externally to the fuel spray portion 3, with the opening at an upstream end between the cylindrical double walls of the main body 29 being closed by a cover-like portion 40 of the base 19. Thus, the fuel F, for the pre-mixture combustion, to be supplied from the second fuel supply system F2 can be introduced into the pre-mixture supply portion 4.

In the main body 29 of the pre-mixture supply portion 4, a fuel supply passage 41 is formed in a gap between the inner cylindrical body 30 and the outer cylindrical body 31. The fuel supply passage 41 is configured to supply the fuel F fed from the second fuel supply system F2 to a plurality of (for example, eight) fuel injection holes 35 respectively formed in the downstream circumferential wall of the outer cylindrical body 31 at a predetermined interval. In the cylindrical intermediate wall 32, a fuel introduction hole 36, for guiding the fuel F to be injected from the respective fuel injection holes 35 into the pre-mixture preparing chamber 37, is formed. The cylindrical intermediate wall 32 covers approximately a half of the downstream part of the outer cylindrical body 31, and the downstream end of the wall 32 is coincident, in the axial position, with the downstream end of the nozzle 23 of the fuel spray portion 3. In addition, a pre-mixture chamber 42 is formed on the downstream side of the cylindrical partition wall 34 and between the cylindrical intermediate wall 32 and the cylindrical outer circumferential wall 33. The upstream end of the cylindrical partition wall 34 is coincident, in the axial position, with the upstream end of the cylindrical intermediate wall 32. The length in the axial direction of the cylindrical partition wall 34 is set such that its downstream end is located downstream a predetermined distance relative to the fuel introduction hole 36. The upstream end of the cylindrical outer circumferential wall 33 is positioned downstream, in the axial direction, a predetermined distance relative to the upstream end of the cylindrical partition wall 34. The downstream end of the cylindrical outer circumferential wall 33 is set to be coincident, in the axial position, with the downstream end of the cylindrical intermediate wall 32.

To the pre-mixture supply portion 4, the fuel F is supplied from the second fuel supply system F2 only under higher intensity combustion as is greater than 50% or more relative to the full load. The fuel F is then injected into the pre-mixture preparing chamber 37, via the fuel injection holes 35 and the fuel introduction hole 36, through the fuel supply passage 41. Thereafter, the injected fuel F is subjected to the primary atomization due to the compressed air CA supplied from the second inner swirler 38. Subsequently, the fuel F having been subjected to the primary atomization is further subjected to the second atomization due to the swirling air stream provided from the second outer swirler 39 in the pre-mixture chamber 42. Consequently, the pre-mixture gas is produced, in which the fuel F and the compressed air CA are well mixed in advance. The pre-mixture gas is then supplied and combusted in the combustion chamber 12, thereby to create a pre-mixture combustion region 51. It should be noted that since the fuel F is not supplied into the pre-mixture supply portion 4 under a lower intensity combustion mode as is lower than 50% or less relative to the full load, only a greater amount of the compressed air CA is supplied into the combustion chamber 12 in that mode.

Figure 4:
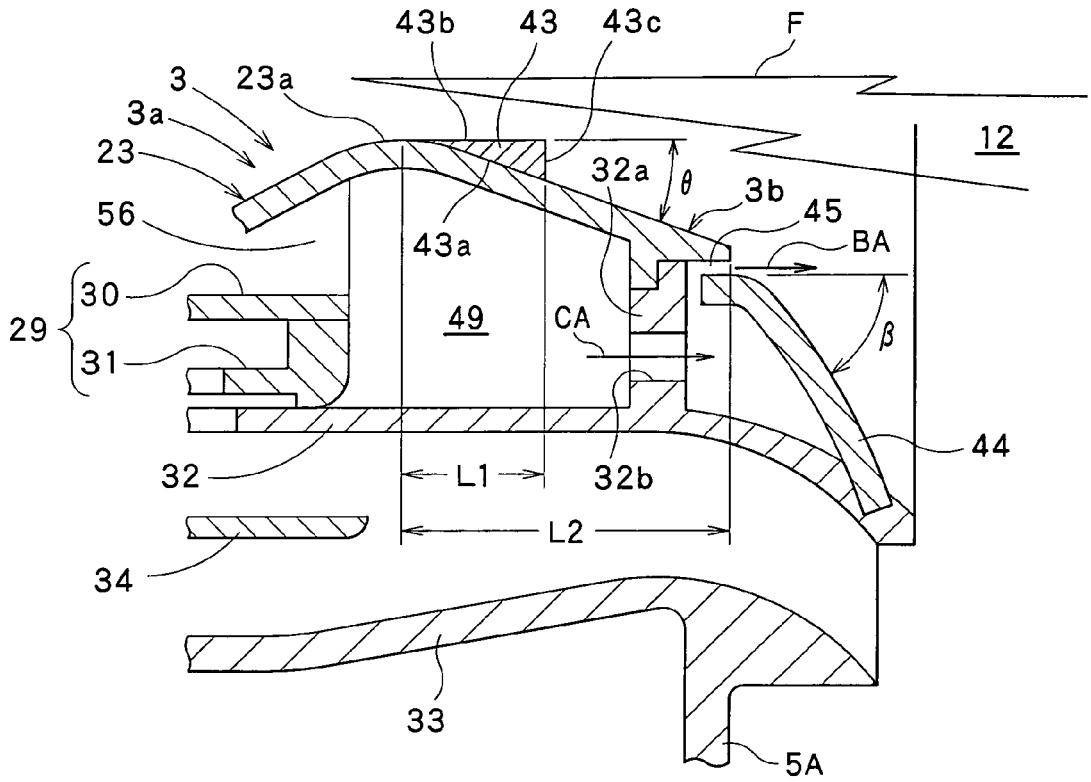
FIG. 4 is an enlarged longitudinal section of a characteristic portion of FIG. 3.

As shown in FIG. 4 in which a characteristic portion of FIG. 3 is enlarged, an annular step member 43 having a triangular longitudinal section is fixed to the combustor 1, at the upstream end of the inner circumferential face of the diffusion passage portion 3*b* in the fuel spray portion 3. Namely, the annular step member 43 extends from the throttling portion 23*a* in the inner circumferential face of the nozzle 23 to a point spaced away a predetermined distance from the throttling portion 23*a*. The step member 43 serves as a fuel diffusion restraining means for restraining the diffusion of the fuel F injected from the fuel atomizing portion. 3*a*, by separating the stream of the fuel F away from the inner circumferential face of the diffusion passage portion 3*b*. Specifically, the step member 43 is configured to have a triangular longitudinal section defined by an arc-shaped fitting face 43*a* adapted to fit the conical inner circumferential face of the diffusion passage portion 3*b*, a guide face 43*b* extending downstream, substantially parallel to the axis C (FIG. 3) of the fuel spray portion 3, from the upstream end of the fitting face 43*a*, and adapted for separation of the fuel stream, and a downstream face 43*c*. The downstream face 43*c* extends substantially vertically to the axis C of the fuel spray portion 3, and connects the respective downstream ends of the guide face 43*b* and fitting face 43*a*.

Between an inner face at the downstream end of the cylindrical intermediate wall 32 and an outer face at the downstream end of the diffusion passage portion 3*b*, an annular guide skirt member 44 is disposed. The guide skirt member 44 is configured to spread outward, in a trumpet-like shape, up to the inner peripheral portion of the pre-mixture supply portion 4, while still keeping the spreading shape of the diffusion passage portion 3*b* of the fuel spray portion 3. A connecting portion 32*a* projecting radially inwardly from a point in the vicinity of the bottom end of the cylindrical intermediate wall 32 is connected with a point in the vicinity of the downstream end of the diffusion passage portion 3*b*. Through the connecting portion 32*a*, an air hole 32*b* is formed. The guide skirt member 44 is fixed, with a gap 45 formed between its distal end and the connecting portion 32*a* as well as the outer face at the downstream end of the diffusion passage portion 3*b*. The gap 45 is in communication with the air hole 32*b*. Accordingly, the compressed air CA introduced from an air introduction passage 56 formed between the nozzle 23 and the inner cylindrical body 30 into an air accumulation chamber 49 formed between the diffusion passage portion 3*b* and the cylindrical intermediate wall 32 will pass through the air hole 32*b* and then be injected, as blowing air BA, through the gap 45, toward the combustion chamber 12.

In the configuration described above, while starting the operation and/or operating under lower intensity combustion of the combustor 1 shown in FIG. 3, the fuel F is supplied from the first fuel supply system F1 only to the fuel spray portion 3 located inside each fuel injection unit 2. Thereafter, the fuel F is diffused together with the compressed air CA, due to the spreading diffusion passage portion 3*b* in the fuel spray portion 3 as well as the similarly spreading guide skirt portion 44. Consequently, the mixture of the fuel F and compressed air CA is injected into the combustion chamber while being diffused and spread, thereby to be readily combustible, thus enhancing the stability of combustion in the diffusion combustion region 50.

Figure 8:
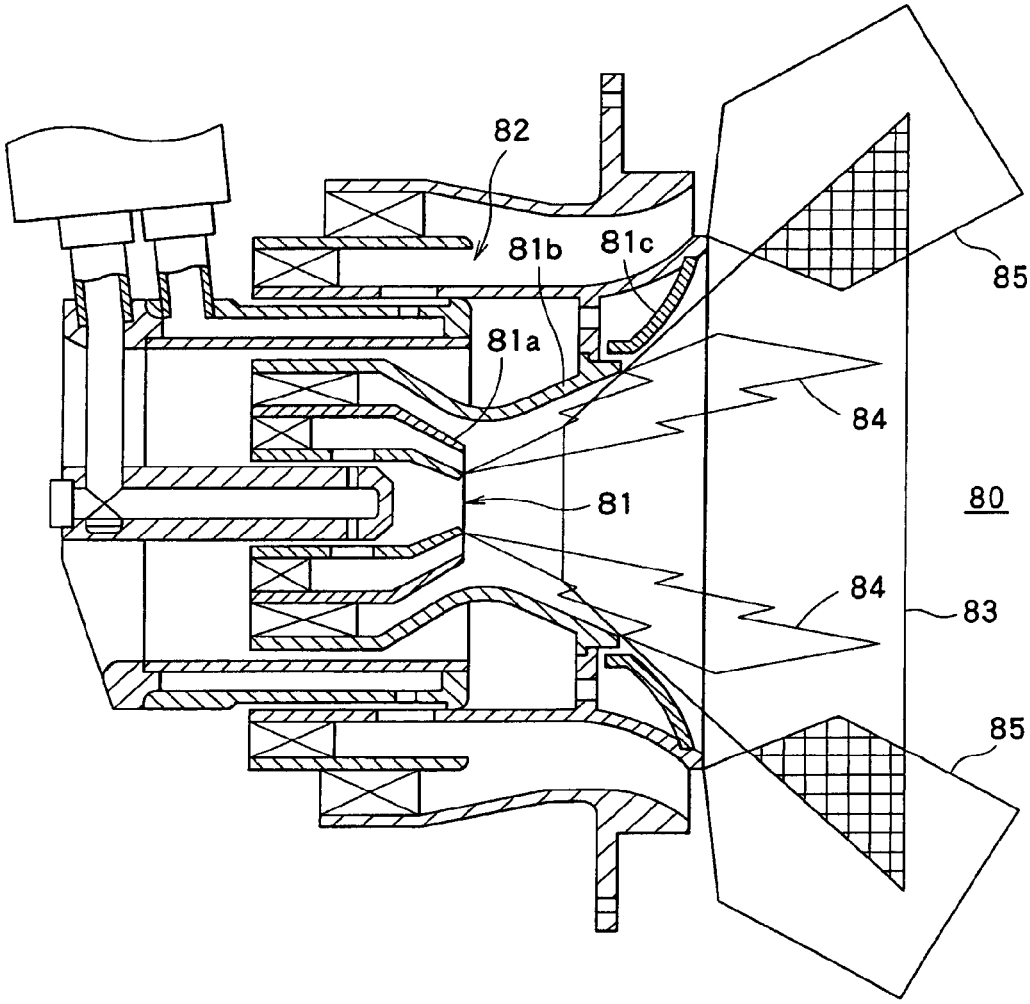
FIG. 8 is a longitudinal section showing a conventional combustor for use in the gas turbine engine.

At this time, the fuel F injected from the fuel atomizing portion 3*a* of the fuel spray portion 3 toward the diffusion passage portion 3*b* is flown along the guide face 43*b* extending substantially parallel to the axis C of the fuel spray portion 3 in the step member 43 shown in FIG. 4, and is then injected out along an extended line depicted on the downstream side from the downstream end of the guide face 43*b*. Thus, the fuel F is separated away from the inner circumferential face of the diffusion passage portion 3*b*. Consequently, as apparently seen from the comparison with the case of FIG. 8, diffusion of the fuel F in the radial direction relative to the fuel spray portion 3 can be suppressed, as such the fuel F can be controlled to concentrate around the axis C of the fuel spray portion 3 without unduly spreading. In this case, since the step member 43 is positioned at a boundary point between the diffusion passage portion 3*b* and the fuel atomizing portion 3*a*, the fuel F can be separated away from the inner circumferential face of the diffusion passage portion 3*b* immediately after being injected into the diffusion passage portion 3*b*. In addition, since the downstream face 43*c* of the step member 43 is substantially orthogonal to the axis C of the fuel spray portion 3, the separation of the stream of the fuel F from the inner circumferential face of the diffusion passage portion 3*b* can be achieved more effectively. Thus, the fuel F can be injected to concentrate around the axis C of the fuel spray portion 3, resulting in provision of a region of a higher fuel concentration around the central portion of the combustion chamber 12, as schematically shown in FIG. 3, thereby to achieve a significantly higher combustion efficiency in the diffusion combustion region 50.

Accordingly, the flame generated due to the mixed gas having a higher fuel concentration can be supplied, without unduly spreading, into the diffusion combustion region 50, concentrating around the central portion of the combustion chamber 12, thereby preventing a great amount of air, which is supplied from the pre-mixture supply portion 4 into the pre-mixture region 51, from being mixed with the flame. Consequently, flame failure of the flame generated in the diffusion combustion chamber 50, due to the great amount of air supplied into the pre-mixture region, can be prevented. In addition, the entire diffusion combustion region 50 can be kept in a fuel concentration range suitable for stabilized combustion. Therefore, the ignition performance, the flame holding performance, and the stability of combustion under lower intensity combustion, can be significantly enhanced.

The step member 43 is configured such that a length L1 as measured along the axis C of the diffusion passage portion 3*b* shown in FIG. 4 is set, relative to a length L2 of the diffusion passage portion 3*b*, between one third of L2 and one half of L2. If the length L1 is less than (⅓) L2, the height of the step member, i.e., the width in the radial direction of the downstream face 43*c*, would be insufficient to provide an appropriate effect in separating the fuel F away from the inner circumferential face of the diffusion passage portion 3*b* as well as restraining the diffusion. Contrary, if the length L1 is greater than (½) L2, the diffusion of air would be suppressed, thus unduly increasing the flowing speed of the mixture of the fuel and air relative to the speed suitable for the combustion, as such making the mixture not likely to be combusted, resulting in unstable combustion. Additionally, an angle θ defined between the guide face 43*b* of the step member 43 and the diffusion passage portion 3*b* and a spreading angle β of the guide skirt member 44 are respectively set, such that, in the annular type combustor 1, an appropriate spreading of the diffusion combustion region 50 can be obtained to ensure smooth transfer of the flame from one to another of the adjacent fuel injection units 2 disposed in the circumferential direction.

While the fuel F injected from the fuel atomizing portion 3*a* is controlled to concentrate around the axis C of the diffusion passage portion 3*b* due to the step member 43, the compressed air CA supplied from the fuel spray portion 3 is provided with a swirling motion due to the respective swirlers 24, 27. Thus, the steam of the fuel F can be spread, to some extent, on the downstream side of the step member 43, thereby preventing the diffusion combustion region 50 from being unduly small around the central portion. Consequently, as shown in FIG. 1, in the annular type combustor 1 in which the fuel injection units 2 are annularly arranged, the transfer of the flame from one to another of the adjacent fuel injection units 2 can be performed smoothly. Although the fuel F separated away from the inner circumferential face of the diffusion passage portion 3*b* due to the step member 43 may contact again with the inner circumferential face of the diffusion passage portion 3*b* on the downstream side of the step member 43 due to the swirling air stream of the compressed air CA, such a re-contacting fuel F will be blown off into the combustion chamber 12 by the effect of the blowing air BA to be injected from the gap 45. This configuration can prevent the fuel F from being in a liquid film state, traveling along the diffusion passage portion 3*b* and guide skirt member 44, without being burned, and then flowing into the pre-mixture combustion region 51.

In the fuel spray portion 3, the first inner swirler 24, which is of a smaller size than that of the first outer swirler 27, is used, and thus the swirling function of the first inner swirler 24 is relatively low. Therefore, more secure control of the injection angle of the fuel injected from the diffusion passage portion 3*b* of the fuel spray portion 3 can be achieved, thus also leading to more enhanced stabilization for the diffusion combustion.

Furthermore, in the combustor 1 described above, the main body 20 of the fuel spray portion 3 and the main body 29 of the pre-mixture supply portion 4 are respectively connected with the base 19 so as to constitute together an inner block BL1 as a single connected body. On the other hand, an outer block BL2 as a single connected body is constructed with members other than the main bodies 20, 29. Namely, the outer block BL2 is constructed by connecting the cylindrical intermediate wall 32 with the cylindrical partition wall 34 via the second inner swirler 38, connecting the cylindrical partition wall 34 with the cylindrical outer wall 33 via the second outer swirler 39, and connecting the cylindrical intermediate wall 32 with the nozzle 23 via the connecting portion 32*a*. The inner block BL1 and the outer block BL2 are connected with each other, by fixing the cylindrical intermediate wall 32 and the outer cylindrical body 31 together, by means of fitting due to a predetermined number of pins 57.

Accordingly, by releasing the fitting between the cylindrical intermediate wall 32 and the outer cylindrical body 31, the outer block BL2 can be separated from the inner block BL1. Thus, maintenance and check for the apparatus can be performed, with only the inner block BL1 being withdrawn and removed from the combustion cylinder 9 shown in FIG. 2.

Figure 5:
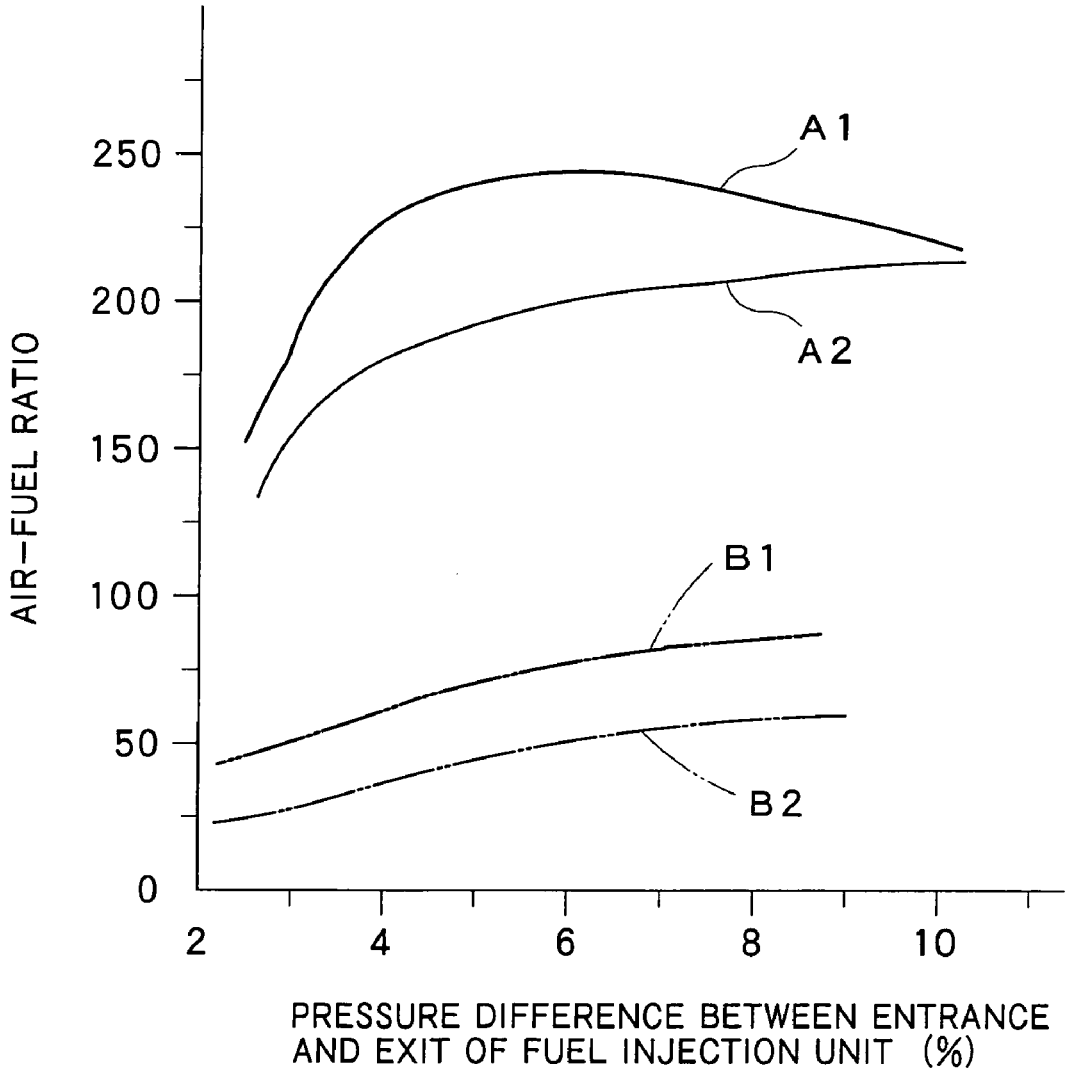
FIG. 5 is a graph showing test results for ignition and flame failure, i.e., a profile of actually measured values of the air-fuel ratio, with respect to the pressure difference between an entrance and an exit of each fuel injection unit.

FIG. 5 is a graph showing test results for ignition and flame failure. The horizontal axis shows the pressure difference between an entrance EN and an exit EX of each fuel injection units 2 shown in FIG. 2, while the vertical axis designates the air-fuel ratio. A curve A1 is a profiling curve expressing an upper limit of the air-fuel ratio, at which flame failure occurs in the combustor 1 of the first embodiment, while a curve B1 is a profiling curve depicting a lower limit of the air-fuel ratio, at which the ignition is still possible in the same combustor 1. A curve A2 is a profiling curve expressing an upper limit of the air-fuel ratio, at which flame failure occurs in the conventional combustor shown in FIG. 8, while a curve B2 is a profiling curve showing a lower limit of the air-fuel ratio, at which the ignition is still possible in the same conventional combustor. According to the test results, in the combustor 1 of FIG. 2, the interference due to the great amount of air supplied from the pre-mixture supply portion 4 with the diffusion combustion region 50 can be avoided, by separating the stream of the fuel F fed from the fuel atomizing portion 3*a* away from the inner circumferential face of the diffusion passage portion 3*b*, and restraining the diffusion of the fuel F, due to the step member 43. Accordingly, in the combustor 1 of FIG. 2, as is apparently seen from the comparison of the curve A1 with A2, the flame failure will not occur until the air-fuel ratio becomes substantially higher than that of the conventional combustor. In addition, as is apparently seen from the comparison of the curve B1 with B2, it was found that the ignition is still possible, even under a significantly higher air-fuel condition than that of the conventional combustor, i.e., even in a state where the fuel to be used is quite few.

Figure 6:
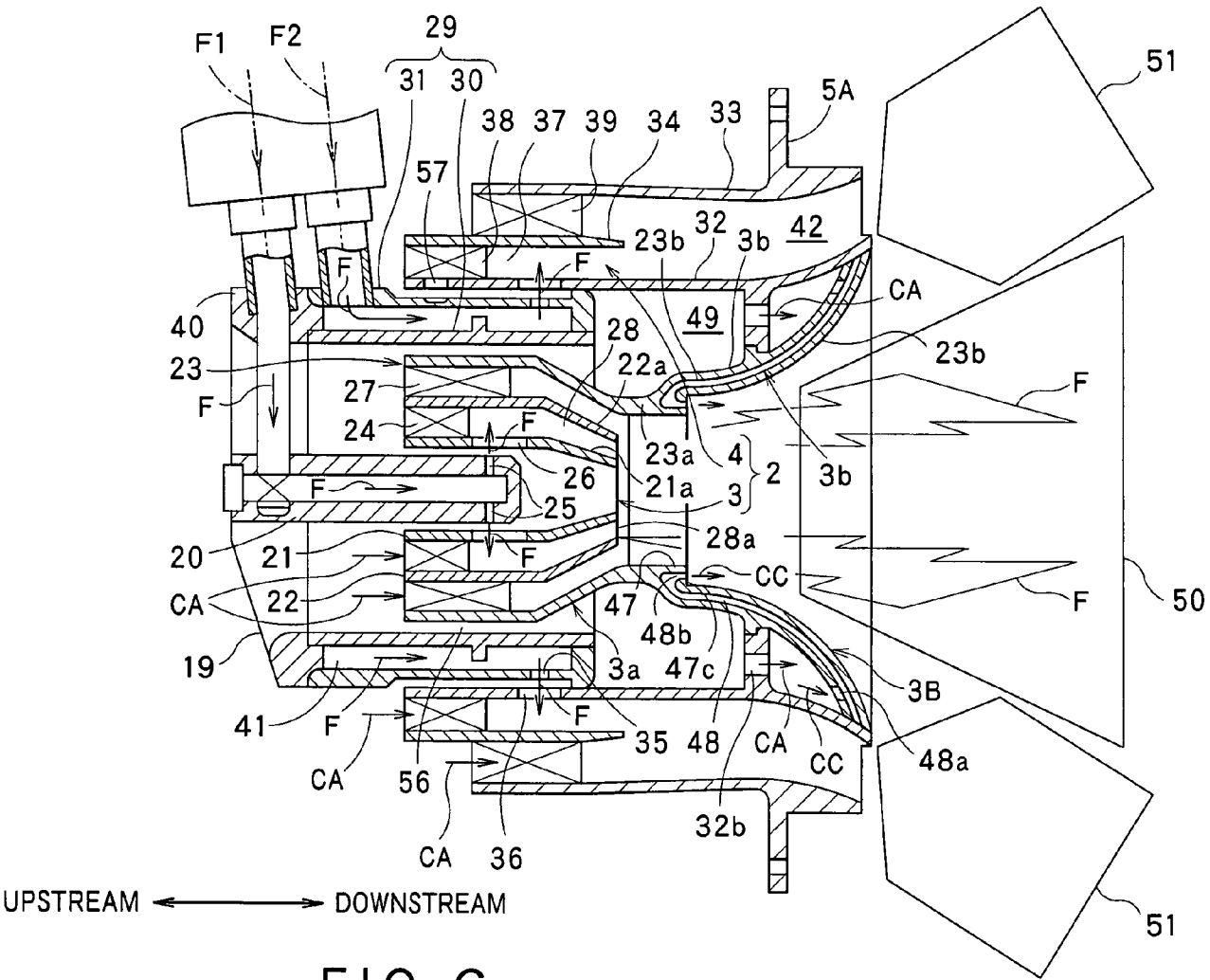
FIG. 6 is a longitudinal section showing the fuel injection unit according to a second embodiment of the present invention.

FIG. 6 shows the fuel injection unit 2 in the combustor for use in the gas turbine engine according to a second embodiment of the present invention. The difference in the fuel injection unit 2 of the combustor in the second embodiment, relative to the one in the first embodiment, is that a diffusion passage portion 3B is disposed on the downstream side of the fuel atomizing portion 3*a* in the nozzle 23 of the fuel spray portion 3, the entire body of the diffusion passage portion 3B being formed integrally from the diffusion passage portion 3*b*, step member 43 and guide skirt portion 44, which are respectively provided as separate members in the first embodiment, and that a cooling air passage 48 is formed to extend from the downstream end of the diffusion passage portion 3B up to the interior of a step member 47. A cooling air introduction port 48*a* formed at the upstream end of the cooling air passage 48 is in communication with the air accumulation chamber 49 via the air hole 32*b*, while the downstream end of the cooling air passage 48 is opened through a cooling air exhaust port 48*b* provided in a downstream face 47*c* of the step member 47.

The fuel injection unit 2 of the second embodiment can be operated in the same manner and can provide the same effect as in the first embodiment. Besides, the compressed air CA introduced into the air accumulation chamber 49 from the air introduction passage 56 can be flown through the air hole 32*b*, enter the cooling air passage 48 via the cooling air introduction port 48*a* as cooling air CC, and then exit the cooling air exhaust port 48*b* formed in the downstream face of the step member 47, toward the combustion chamber 12. Accordingly, since the diffusion passage portion 3B including the step member 47 to be exposed to radiant heat from the flame generated in the diffusion combustion region 50 can be effectively cooled, the need for forming the diffusion passage portion 3B including the step member 47 from an expensive material superior in the heat resistance can be eliminated. In addition, since the cooling air exhaust port 48*b* is formed in the downstream face 47*c* of the step member 47, more effective cooling for the downstream face 47*c* of the step member 47, which will be directly subjected to the radiant heat from the flame in the diffusion combustion region 50, can be ensured. With the cooling air CC discharged from the cooling air exhaust port 48*b*, the atomization for the fuel F, after separated away from the inner circumferential face 3B due to the step member 47, can be further promoted.

Figure 7:
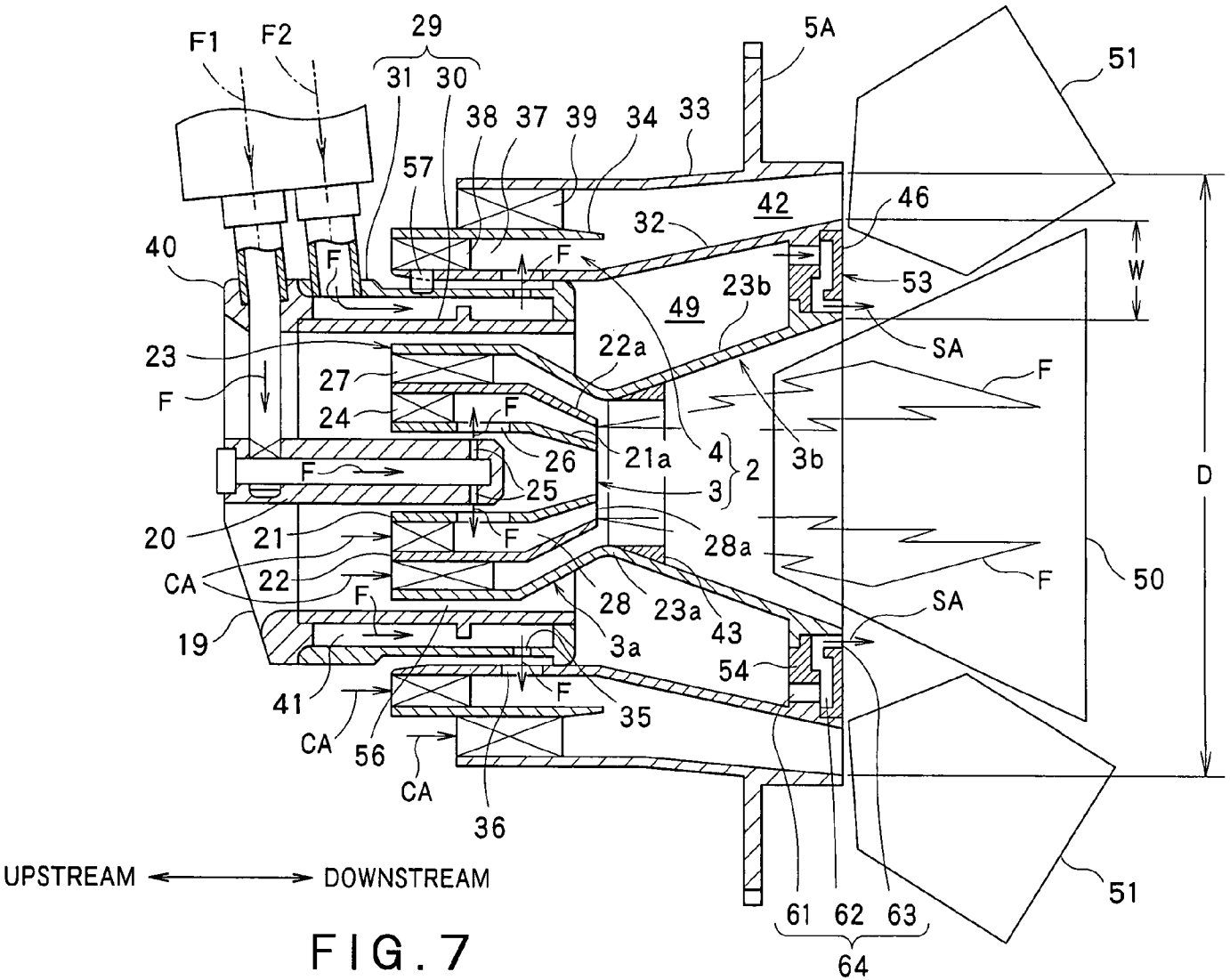
FIG. 7 is a longitudinal section showing the fuel injection unit according to a third embodiment of the present invention.

FIG. 7 shows the fuel injection unit 2 in the combustor for use in the gas turbine engine according to a third embodiment of the present invention. The difference in the fuel injection unit 2 of the combustor in the third embodiment, relative to the one in the first embodiment, is that an annular separation portion 53 for separating the diffusion fuel region 50 to be created by the fuel spray portion 3 from the pre-mixture combustion region 51 to be created by the pre-mixture supply portion 4, and an air curtain forming means 64 for enhancing the separation of both of the regions 50, 51 by injecting separating air SA between the diffusion combustion region 50 and the pre-mixture combustion region 51 through the separation portion 53, are provided between the downstream end of the nozzle 23 of the fuel spray portion 3 and the downstream end of the cylindrical intermediate wall 32 of the pre-mixture supply portion 4.

The diameter spreading portion 23*b* of the nozzle 23, i.e., the diffusion passage portion 3*b*, is formed into a conical shape extending up to the same position as the downstream end of the pre-mixture supply portion 4. The separation portion 53 includes an annular cover member 46 arranged to close a space to be defined between the conical diffusion passage portion 3*b* and the cylindrical intermediate wall 32, wherein the downstream ends of the respective members are spaced apart from each other in the radial direction. A downstream face of the separation portion 53 opposed to the combustion chamber 12 is a flat face extending along the radial direction. An annular end member 54 is attached between the downstream end of the nozzle 23 and the downstream end of the cylindrical intermediate wall 32, and a plurality of air holes 61 each communicating with the air accumulation chamber 49 are formed in the end member along the circumferential direction at an equal interval. Between the cover member 46 and the end member 54, an annular air passage 62 communicating with each air hole 61 is formed. Additionally, an annular air injection port 63 communicating with the air passage 62 is formed between the inner circumferential face of the cover member 46 and the downstream end of the diameter spreading portion 23*b* of the nozzle 23. In this manner, the air curtain forming means 64, which is adapted to inject the compressed air CA accumulated in the air accumulation chamber 49, as the separation air SA, through the separation portion 53, is provided by the air holes 61 and the air passage 62.

With the combustion injection unit 2 of this embodiment, the fuel F supplied from the fuel spray portion 3 can be injected, while starting the operation and/or operating under lower intensity combustion, while being concentrated around the axis C of the fuel spray portion 3, due to the step member 43, as is similar to the first embodiment. In addition, the fuel F can be injected into the combustion chamber 12 while its spreading is restrained by the separation portion 53. Besides, an air curtain formed between the diffusion combustion region 50 and the pre-mixture combustion region 51 due to the separation air SA injected into the combustion chamber 12 form the air injection port 63 of the air curtain forming means 64 can prevent a part of the fuel F sprayed from the diffusion passage portion 3*a* from traveling along the separation portion 53 and then flowing into the pre-mixture combustion region 51. Thus, undue spreading of the flame generated in the diffusion combustion region 50 can be further restrained. Consequently, unnecessary mixing of a great amount of air supplied into the pre-mixture combustion region 51 with the flame generated in the diffusion combustion region 50 due to the fuel F injected into the combustion chamber 12 from the fuel spray portion 3 can be prevented more securely. Additionally, since the fuel F injected from the diffusion passage portion 3*b* of the fuel spray portion 3 is further subjected to three-dimensional atomization due to the separating air SA for constituting the air curtain, more stabilized diffusion combustion can be achieved.

The separation portion 53 is designed to have a width W in the radial direction, relative to the inner diameter D of the cylindrical outer circumferential wall 33 of the pre-mixture supply portion 4, within the range W: 0.13 D to 0.25 D. If the width W in the radial direction of the separation portion 53 is less than 0.13 D, the diffusion combustion region 50 and the pre-mixture combustion region 51 can not be effectively separated relative to each other, even by using the separation portion 53. Contrary, if the width W in the radial direction exceeds 0.25 D, the diffusion of the air to be used for the diffusion combustion would be insufficient, thus unduly increasing the flowing speed of the mixture of the fuel and air relative to the speed suitable for the combustion, as such making the mixture not likely to be combusted, resulting in deterioration of the stability of combustion. In addition, in the annular-type combustor, in which the plurality of fuel injection units 2 are arranged annularly as shown in FIG. 1, smooth transfer of the flame from one to another of the adjacent fuel injection units 2 can not be performed well.

Further preferred aspects of the present invention can be mentioned as follows.

[First Aspect]

In the combustor 1 of a first aspect, the fuel spray portion 3 includes the cylindrical main body 20 having a bottom portion and adapted to inject the fuel F to be used for the diffusion combustion, the cylindrical inner circumferential wall 21 having a nozzle-like shape tapering off downstream and fitted around the main body 20, the cylindrical intermediate wall 22 having a nozzle-like shape tapering off downstream and arranged externally to the cylindrical inner circumferential wall 21, the diffusion passage portion 3*b* having a nozzle-like shape spreading downstream like a trumpet and arranged externally to the cylindrical intermediate wall 22, the first inner swirler 24 positioned between the cylindrical inner circumferential wall 21 and the cylindrical intermediate wall 22, and the first outer swirler 27 positioned between the cylindrical intermediate wall 22 and the diffusion passage portion 3*b*.

[Second Aspect]

In the combustor 1 of a second aspect, the effect to be provided by the first inner swirler 24 is controlled to be less than the effect to be provided by the first outer swirler 27.

[Third Aspect]

In the combustor 1 of a third aspect, the fuel spray portion 3 includes the pre-mixture preparing chamber 37 and the pre-mixture chamber 42.

[Fourth Aspect]

In the combustor of 1 a fourth aspect, the fuel spray portion 3 includes the inner block BL1 including the fuel spray portion and the outer block BL2 not including the fuel spray portion, wherein the inner block BL1 and outer block B2 can be separated relative to each other.

Although the invention has been described in its preferred embodiments with a certain degree of particularity, obviously many changes and variations are possible therein. It is therefore to be understood that the present invention may be practiced otherwise than as specifically described herein without departing from the scope and spirit thereof.

The invention claimed is:

1. A combustor of a gas turbine engine, comprising:

a fuel spray portion configured to spray a fuel to create a diffusion combustion region in a combustion chamber, the fuel spray portion including a fuel atomizing portion configured to atomize the fuel, and a diffusion passage portion disposed downstream of the fuel atomizing portion, the diffusion passage portion having a curved tube shape spreading radially outwardly in a downstream direction and being configured to diffuse the fuel and the air;

a pre-mixture supply portion configured to supply a pre-mixture gas including the fuel and an air to create a pre-mixture combustion region in the combustion chamber, the pre-mixture supply portion being positioned concentrically with the fuel spray portion to surround the fuel spray portion; and fuel diffusion restraining means disposed on and projecting from an inner circumferential face of the diffusion passage portion for restraining a diffusion of an injected fuel by separating a stream of the injected fuel away from the inner circumferential face, the fuel diffusion restraining means having a triangular longitudinal section having an inner face that is substantially parallel with an axis of the fuel spray portion, wherein the inner face of the triangular longitudinal cross section of the fuel diffusion restraining means is located radially inward of the fuel spray portion with respect to the axis of the fuel spray portion.

2. The combustor of a gas turbine engine according to claim 1, wherein only the air is supplied from the pre-mixture supply portion into the diffusion combustion region while starting an operation of the engine and/or operating the engine under low intensity combustion.

3. The combustor of a gas turbine engine according to claim 1, wherein the fuel diffusion restraining means is located at an upstream end of the diffusion passage portion.

4. The combustor of a gas turbine engine according to claim 1, wherein the fuel diffusion restraining means includes an annular step member having the triangular longitudinal section.

5. The combustor of a gas turbine engine according to claim 4, wherein the step member has a length L1 as measured along an axial direction of the diffusion passage portion, and the diffusion passage portion has a length L2 as measured along the axial direction, the length L1 being set between one third of L2 and one half of L2.

6. The combustor of a gas turbine engine according to claim 4, wherein a passage for a cooling air to cool the step member is formed in the step member.

7. The combustor of a gas turbine engine according to claim 6, wherein the passage for the cooling air has an exhaust port for discharging the cooling air from a downstream face of the step member into the diffusion passage portion.

* * * * *